US006723935B1

(12) United States Patent
Watanabe

(10) Patent No.: US 6,723,935 B1
(45) Date of Patent: Apr. 20, 2004

(54) KEYSWITCH DEVICE AND KEYBOARD DEVICE

(75) Inventor: Makoto Watanabe, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/395,507

(22) Filed: Mar. 24, 2003

(51) Int. Cl.[7] ..... H01H 13/70
(52) U.S. Cl. ..... 200/344
(58) Field of Search ..... 200/5 A, 517, 200/344, 345; 400/490, 491, 491.2, 495, 495.1, 496

(56) References Cited

U.S. PATENT DOCUMENTS 5,329,084 A * 7/1994 Watanabe et al. ..... 200/344
5,823,325 A * 10/1998 Lin ..... 200/344
6,020,566 A * 2/2000 Tsai ..... 200/344
6,100,482 A * 8/2000 Koma et al. ..... 200/344
6,399,909 B1 * 6/2002 Okada ..... 200/344
6,509,536 B2 * 1/2003 Sasaki ..... 200/344

FOREIGN PATENT DOCUMENTS

JP 11-16440 1/1999 ..... H01H/13/14

* cited by examiner

*Primary Examiner*—Michael A. Friedhofer
(74) *Attorney, Agent, or Firm*—Brinks Hofer Gilson & Lione

(57) ABSTRACT

A keyswitch device includes first to third levers, a holder, and a switch. One side of each lever rotatably engages a base plate. The holder is supported so as to be movable vertically with respect to the base plate by being engaged with the other side of each lever. The switch is disposed between the base plate and the holder, and is used to perform a switching operation when the holder is moved vertically. A rotary shaft of the third lever is disposed so as to cross rotary shafts at engaging sections of the respective first and second levers.

12 Claims, 6 Drawing Sheets

KEYSWITCH DEVICE AND KEYBOARD DEVICE

BACKGROUND OF THE INVENTION

1. Field of the Invention

The present invention relates to a keyswitch device suitable for use as an input switch device or in a keyboard device used as an input/output device of, for example, a word processor or a personal computer, and a keyboard device including the keyswitch device.

2. Description of the Related Art

Hereunder, a related X-shaped keyswitch device used in a keyboard device will be described with reference to FIGS. 4 and 5. A mount member 31 is formed of, for example, a metallic plate and comprises a bottom wall 31*a*, a plurality of relatively long supporting sections 31*b*, and a plurality of semi-circular arc shaped holding sections 31*c*. In order to form the supporting sections 31*b*, cuts are formed in the bottom wall 31*a* and the cut portions that are joined at two sides are raised. These cut-and-raised portions are disposed side by side and correspond to the supporting sections 31*b*. In order to form the holding sections 31*c*, cuts are formed in the bottom wall 31*a* in a cantilever manner and the cut portions that are joined at one side are raised. These cut-and-raised portions are disposed side by side and correspond to the holding sections 31*c*, each of which forms a pair with its associated supporting section 31*b*. A flexible substrate (not shown) having a plurality of stationary contacts is disposed on the top surface of the bottom wall 31*a*. A movable contact member 33 comprises a cup-shaped movable section 33*a*, formed of resin or the like, and a contact section 33*b*, disposed on the upper surface of the inner portion of the movable section 33*a*. The movable contact member 33, opposing stationary contacts 32, is mounted to the flexible substrate. When the movable section 33*a* is pushed and moved, the contact section 33*b* comes into contact with the stationary contacts 32, whereas, when the movable section 33*a* is released, the movable section 33*a* returns to its original state by itself, causing the contact section 33*b* to move out of contact with the stationary contacts 32. A first lever 34 is molded out of synthetic resin and has a U shape. It comprises a pair of arms 34*a*, a connecting section 34*b* connected to one end of each arm 34*a*, and a circular cylindrical engager 34*c* disposed at the other end of each arm 34*a*. A second lever 35 is molded out of synthetic resin and has an H shape. It comprises a pair of arms 35*a*, a connecting section 35*b* connected to the central portion of each arm 35*a*, and circular cylindrical engagers 35*c* and 35*d* disposed at respective ends of each arm 35*a*. By positioning the second lever 35 inside the first lever 34 and placing them so that their central portions are aligned, the first and second levers 34 and 35 are rotatably combined in the form of a cross by a rotary shaft 34*d*, so that the combined form of the first and second levers 34 and 35 has an X-shaped pantograph structure. With the rotary shaft 34*d* as a fulcrum, the upper sides of the first and second levers 34 and 35 can move vertically. The first and second levers 34 and 35 combined in this manner are mounted to the mount member 31 in the following way. First, as shown in FIG. 4, one end of one arm 35*a* and one end of the other arm 35*a* of the second lever 35 are pushed towards each other in the directions of arrows X. With these ends of the arms 35*a* moved towards each other, the engagers 35*c* are aligned with their respective holding sections 31*c*. When, after the alignment, the ends of the arms 35*a* that have been pushed towards each other in the directions of arrows X are released, the arms 35*a* return to their original states by themselves, causing the engagers 35*c* to be engaged inside the respective holding sections 31*c*. Next, as shown in FIG. 4, one end of one arm 34*a* and one end of the other arm 34*a* of the first lever 34 are pushed towards each other in the directions of arrows Y. With these ends of the arms 34*a* moved towards each other, the engagers 34*c* are aligned with the respective supporting sections 31*b*. When, after the alignment, the ends of the arms 34*a* that have been pushed towards each other in the directions of arrows Y are released, the arms 34*a* return to their original states by themselves, causing the engagers 34*c* to be engaged inside the respective supporting sections 31*b*. In this way, both the first and second levers 34 and 35 are mounted to the mount member 31 with the pairs of arms 34*a* and 35*a* in pushed states. When the first and second levers 34 and 35 are mounted to the mount member 31, the movable contact member 33 is positioned below the central portions of the crossing portions of the first and second levers 34 and 35, so that the movable contact member 33 can be pushed by the second lever 35. A keytop 36 is molded out of synthetic resin and has the shape of an inverted boat. It comprises guides 36*a* and 36*b*. The guide 36*a* is a vertical groove disposed at the inner portion of the lower surface of the keytop 36. The guide 36*b* is a horizontal groove disposed at the inner portion of the lower surface of the keytop 36. The keytop 36 is mounted to and supported by the first and second levers 34 and 35 by fitting the connecting section 34*b* of the first lever 34 to the guide 36*a* and fitting the engagers 35*d* of the second lever 35 to the guide 36*b*. The one keytop 36 having such a structure, the pair of first and second levers 34 and 35, the movable contact member 33, the stationary contacts 32, and the mount member 31 form one keyswitch device. By disposing a plurality of such keyswitch devices, a keyboard device is formed. Next, the operation of such a related keyswitch device will be given. First, when the top surface of the keytop 26 is pressed, the first and second levers 34 and 35 are pushed, so that, with the rotary shaft 34*d* as a fulcrum, the first and second levers 34 and 35 are rotated and moved downward. At this time, the engagers 35*c* of the second lever 35 are rotated while they are held by their respective holding sections 31*c*, and the engagers 34*c* of the first lever 34 are slid horizontally while they are supported by their respective supporting sections 31*b*. At the keytop 36, the engagers 35*d* of the second lever 35 are slid horizontally inside the guide 36*b*, and the connecting section 34*b* of the first lever 34 is slid vertically inside the guide 36*a*.

By the downward movement of the first and second levers 34 and 35, the movable section 33*a* of the movable contact member 33 is pushed downward, causing the contact section 33*b* to come into contact with the stationary contacts 32, so that the keyswitch device is turned on. Next, when the keytop 36 is released, the movable section 33*a* returns to its original state, causing the first and second levers 34 and 35 to be pushed back upward. This causes the keytop 36 to move upward, so that the first and second levers 34 and 35 and the keytop 36 return to their original states before being pushed, so that the keyswitch device is turned off.

The keyswitch device having the above-described structure is widely used in, for example, keyboard devices of personal computers. However, size reduction of electronic devices in recent years has resulted in an increased tendency for a demand for smaller and thinner keyswitch devices. However, in the keyswitch device having the structure shown in FIGS. 4 and 5, the rotary shaft 34*d* serving as the center of rotation of the levers 34 and 35 is at the centers in the lengthwise direction of the levers 34 and 35, the keytop 36 is connected to the top sides of the levers 34 and 35 with the rotary shaft 34*d* as the center, and the bottom sides of the levers 34 and 35 are connected to the mount member 31, so that, as the levers 34 and 35 are shortened for the purpose of forming a smaller and thinner keyswitch device, a limit in the lengths of the levers 34 and 35 that allow smooth rotation is reached, so that further reduction in size and thickness cannot be achieved. In addition, in the keyswitch device having their levers disposed in the form of an X shape as viewed from a side, when a top peripheral edge of the top surface at a bearing side of the keytop 36 is pressed, the keytop 36 may tilt in directions A and B in FIG. 5, in which case it is pressed without being moved horizontally downward. In such a case, the contact section 33*b* may not come into contact with the stationary contacts 32 even if the keytop is pressed. Therefore, there is a demand for a keyswitch device which makes it possible to perform a key input operation by reliably causing the contact section to come into contact with the stationary contacts even when a peripheral edge of the top surface of the keytop is pressed by, for example, a finger.

SUMMARY OF THE INVENTION

The present invention has been achieved to overcome the aforementioned problems, and has as its object the provision of a keyswitch device which makes it possible to perform a key input operation by reliably causing a contact section to come into contact with a stationary contact even when a peripheral edge of the top surface of a keytop is pressed by, for example, a finger. It is another object of the present invention to provide a keyboard device which comprises the keyswitch device, which can be easily reduced in size, and which can be easily operated.

To these ends, according to one aspect of the present invention, there is provided a keyswitch device comprising a base; a plurality of levers, one side of each lever movably engaging the base; a keytop supported so as to be movable vertically with respect to the base by being engaged with the other side of each lever; and a switch for performing a switching operation as the keytop is moved vertically. In the keyswitch device, rotary shafts for allowing rotation of the respective levers within respective rotational planes are disposed at respective engagers at both sides of the levers. One of the engagers at each lever is a first engager for movably supporting one of the rotary shafts at the base or the keytop. The other engager at each lever is a second engager for rotatably supporting the other rotary shaft. The rotary shafts disposed at the engagers of at least one of the plurality of levers are oriented so as to cross the rotary shafts or rotary shaft lines disposed at the engagers of another lever.

In the keyswitch device having the above-described structure, the rotary shafts of at least one lever supporting the keytop are oriented so that they cross the rotary shafts of at least one other lever. In other words, unlike the related keyswitch device in which two levers are such that a shaft is fixed at the location where they cross, the levers independently engage the base and the keytop. By virtue of such a structure, even if the lengths of the levers are reduced for reducing the size and thickness of the keyswitch device, the operability of the keyswitch device at the time of a key input operation is not impaired, and the keyswitch device can be more easily reduced in size and thickness than the related keyswitch device having an X-shaped supporting structure.

When a peripheral edge of the top surface of the keytop is pressed at the time of a key input operation, the keytop is not moved downward in a tilted state, but is moved downward in a substantially horizontal state. For example, if the case of supporting the keytop by two levers is considered, when, as in the related keyswitch device, the rotary shafts at the keytop side of these levers are disposed parallel to each other, the keytop can tilt in a direction perpendicular to these rotary shafts. However, in the structure of the present invention, tilting of the rotary shafts of one of the levers in the direction of rotation of the rotary shafts is restricted by the other lever whose rotary shafts cross these rotary shafts, so that the keytop is moved vertically in a horizontal state. Therefore, according to the keyswitch device of the present invention, rattling of the keytop in the horizontal direction can be prevented from occurring, and the keytop is moved vertically without being tiled, so that the switch can reliably perform a switching operation at the time of a key input operation.

In a first form, the plurality of levers comprise a first lever, a second lever, and a third lever, with the rotary shafts of the first and second levers being disposed parallel to each other, and the rotary shafts of the third lever being oriented so as to intersect the rotary shafts of the first and second levers. The keyswitch device having such a structure can be easily reduced in thickness. In the keyswitch device, since the keytop is supported by a pair of levers and a lever that intersects these levers, tilting of the keytop when it is moved vertically does not easily occur, so that the switch can reliably perform a switching operation, thereby making it possible to prevent a user from improperly pressing the keyswitch device.

In a second form, when the structure of the first form is used, the engager of the first lever and the keytop and the engager of the second lever and the keytop are disposed outwardly of the engager of the first lever and the base and the engager of the second lever and the base, respectively, the engager of the first lever and the keytop and the engager of the second lever and the keytop are the second engagers that rotatably support the rotary shafts, and the engager of the first lever and the base and the engager of the second lever and the base are the first engagers that movably support the rotary shafts. According to the structure, since a pair of levers are folded below the keytop when the keytop is moved vertically, the keytop can be smoothly moved vertically without being tilted. In addition, the levers do not protrude beyond the width of the keytop.

In a third form, when the structure of the second form is used, at the engager of the first lever and the base and at the engager of the second lever and the base, the rotary shaft of the first lever and the rotary shaft of the second lever engage respective hook-shaped slide bearings disposed at the base, and the rotary shafts of the first and second levers are slidable within a range in which the rotary shafts are guided in the respective hook-shaped slide bearings. According to the above-described structure, since the slide bearings are formed with hook shapes, the rotary shafts of the first and second levers can be easily engaged with the respective slide bearings.

In a fourth form, when the structure of the third form is used, the first lever and the second lever are each sandwiched at a pair of the hook-shaped slide bearings that are disposed at the base and that engage the first and second levers, and the positions of the first lever and the second lever in the lengthwise directions of the rotary shafts are restricted by the respective pairs of the hook-shaped slide bearings. According to the structure, since movement of the first and second levers in the directions of the rotary shafts is restricted, it is possible to effectively restrict rattling of the keytop.

In a fifth form, when the structure of the first form is used, the third lever is sandwiched at a pair of hook-shaped rotary bearings disposed at the base, and the position of the third lever in the lengthwise direction of the rotary shafts is restricted by the hook-shaped rotary bearings. According to the structure, it is possible to effectively restrict rattling of the keytop.

In a sixth form, when the structure of the first form is used, the keytop and the first and second levers are engaged by disposing the shafts of the first and second levers in respective bearings of the keytop, one of the bearings of the keytop is sandwiched by side walls at both sides of the shaft of the first lever, the other bearing of the keytop is sandwiched by side walls at both sides of the shaft of the second lever, and the positions of the bearings of the keytop in the lengthwise directions of the bearings are restricted by the side walls. According to the structure, movement of the keytop engaging the first and second levers can be restricted, so that a keyswitch device which rattles little can be realized.

In a seventh form, when the structure of the first form is used, the keytop and the third lever are engaged by disposing the shaft of the third lever in a slide bearing of the keytop, and the shaft is disposed and slidable on a guide plate disposed at the slide bearing.

In an eighth form, when the structure of the one aspect is used, the keytop comprises a holder engaging each lever and a key cap adhered to the holder. By virtue of such a structure, since the structural members, including the holder, the levers, and the base, can be used as common members regardless of the type of key cap, a keyswitch device which has a wide range of application and which can allow easy replacement of, for example, the key cap can be provided.

In a ninth form, when the structure of the one aspect is used, the levers each comprise a pair of arms and at least one connecting section that connects the arms, the levers have a U shape or a frame shape, and the first engager and the second engager are disposed on respective sides of the arms. By virtue of such a structure, since the switch can be disposed at the inner side of the U-shaped or frame-shaped levers, space can be effectively used, so that size reduction of the keyswitch device can be easily achieved. In addition, since the rotary shafts are disposed so as to pass through the at least one connecting section, the keytop can be kept more firmly in a horizontal state, so that a keyswitch device whose keytop does not tilt easily when it is moved vertically can be provided.

In a tenth form, when the structure of the one aspect is used, the rotary shafts of levers whose rotary shafts cross each other are disposed at right angles. In other words, the keyswitch device has a structure comprising a lever whose rotary shafts are perpendicular to the rotary shafts of another lever. By disposing the rotary shafts of the levers perpendicular to each other, rattling of the keytop in the horizontal direction and tilting of the keytop when it is moved vertically can most effectively be prevented from occurring, so that a keyswitch device having excellent operability can be provided. In addition, when the rotary shafts of the levers are disposed perpendicular to each other, the rotary shafts of the levers can be disposed along a plurality of side edges of the keytop that ordinarily has a square shape in plan view, so that space between the keytop and the base can be more effectively used.

According to another aspect of the present invention, there is provided a keyboard device comprising any one of the above-described keyswitch devices. The keyboard device comprising the keyswitch device of the present invention is such that the keytop of the keyswitch device can be moved vertically in a constantly horizontal state. Therefore, when the keyswitch device is pressed, a key input operation can be reliably performed, so that a keyboard having excellent operability can be provided.

DESCRIPTION OF THE PREFERRED EMBODIMENTS

Figure 1:
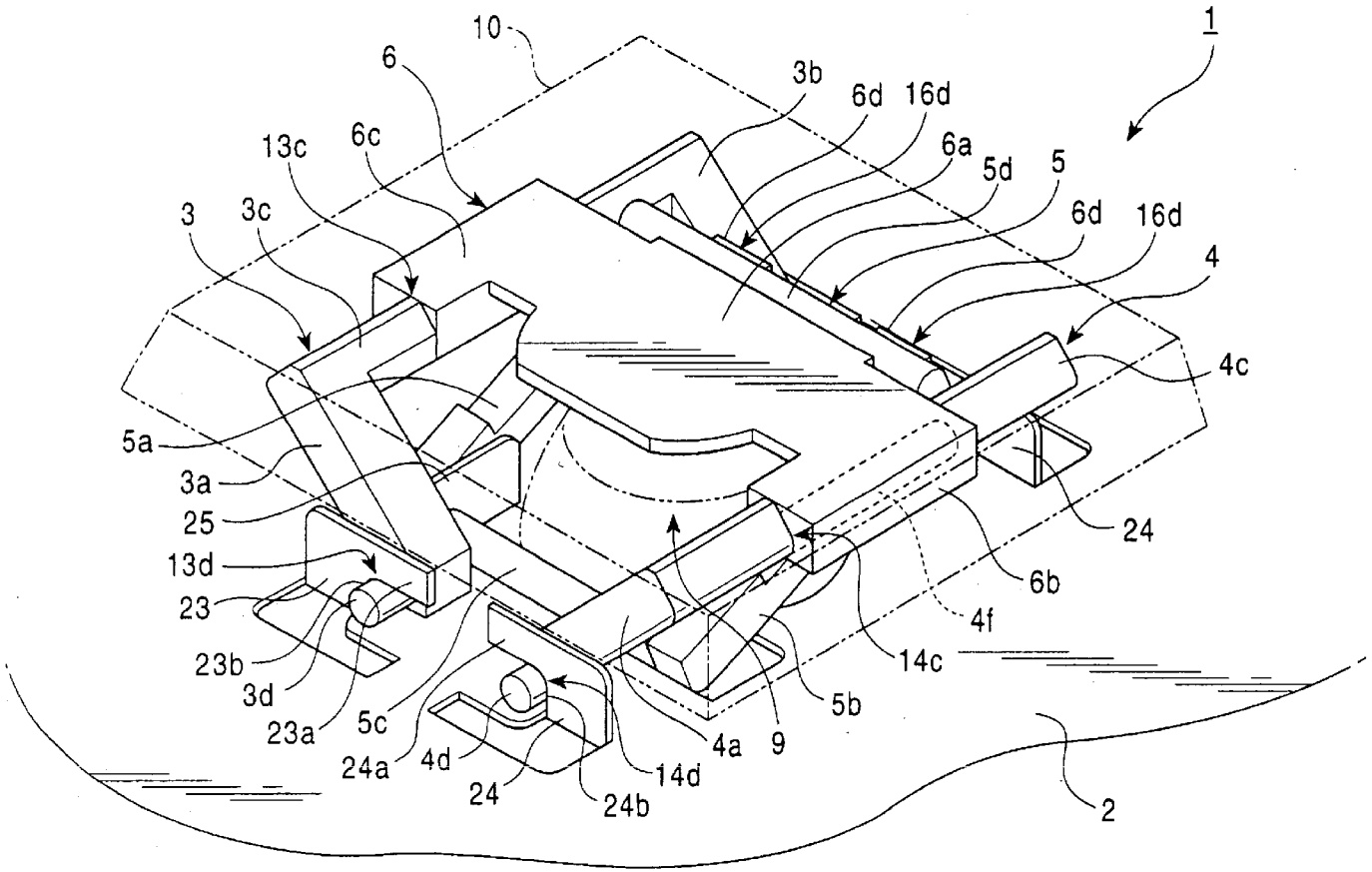
FIG. 1 is a structural perspective view of a keyswitch device of an embodiment of the present invention.
Figure 2:
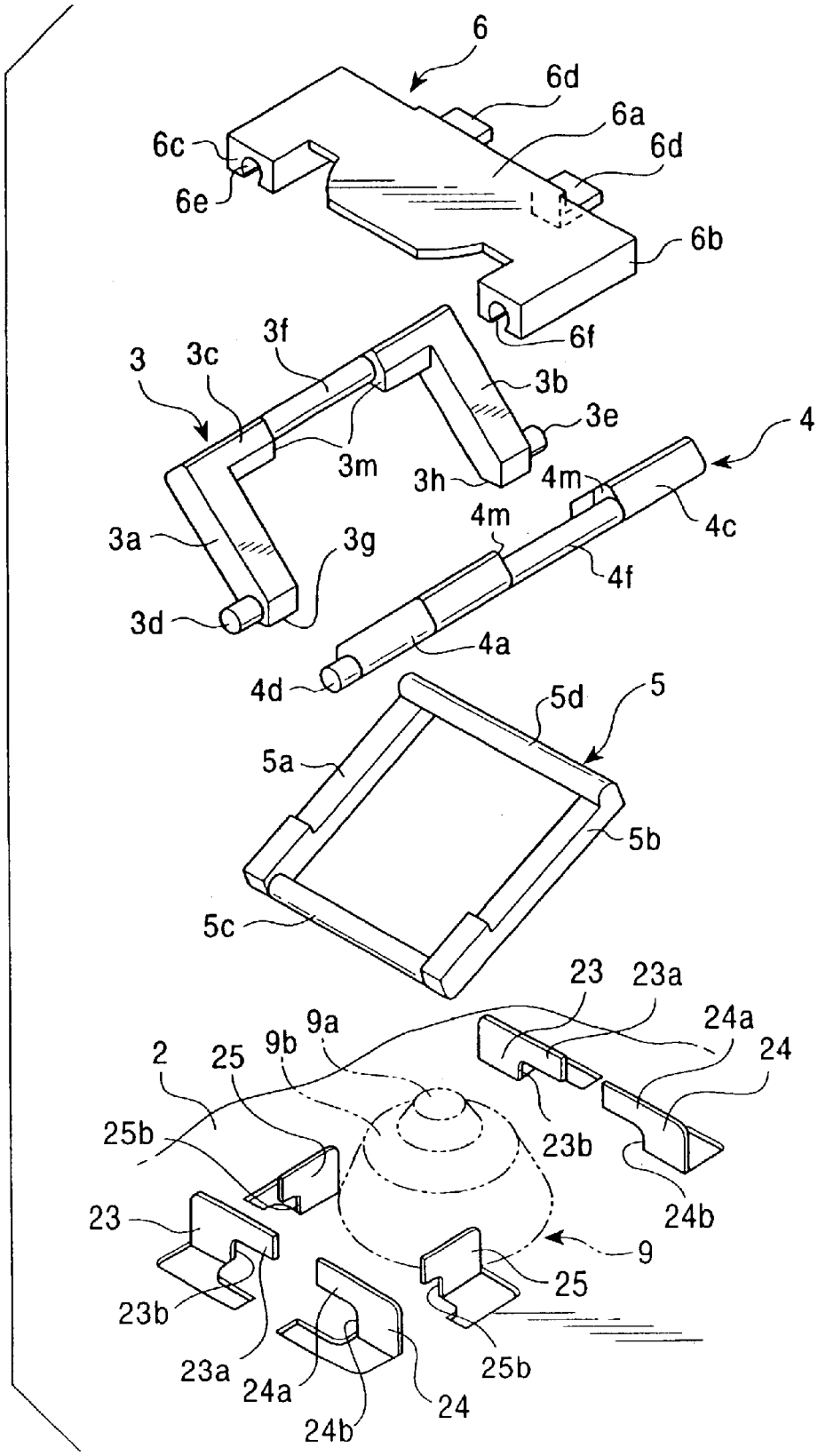
FIG. 2 is an exploded perspective view of the keyswitch device shown in FIG. 1.
Figure 3A:
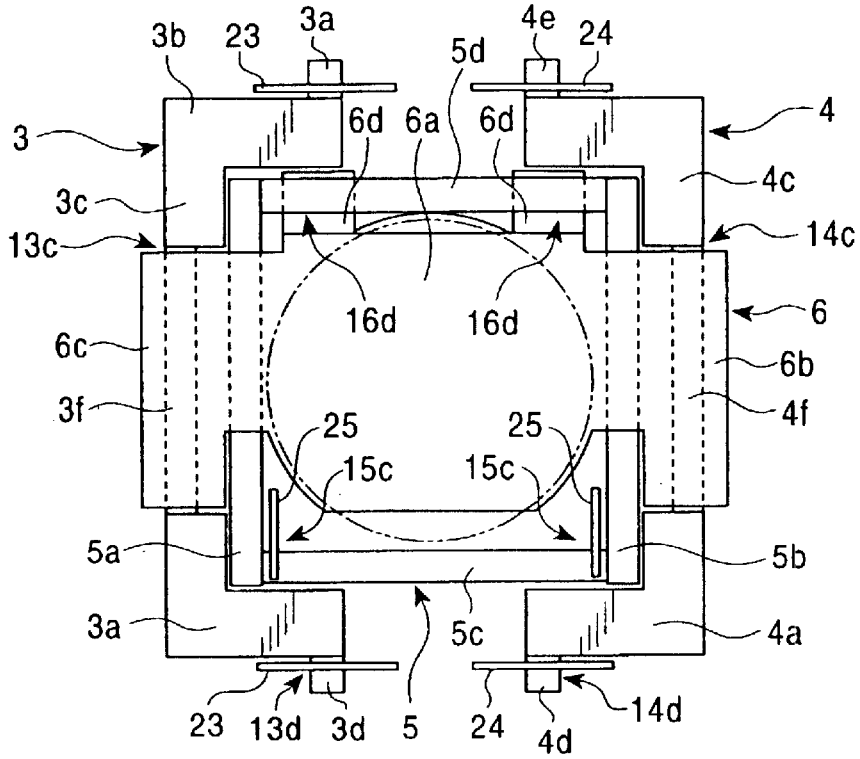
FIG. 3A is a top perspective view of the keyswitch device shown in FIG. 1.
Figure 3B:
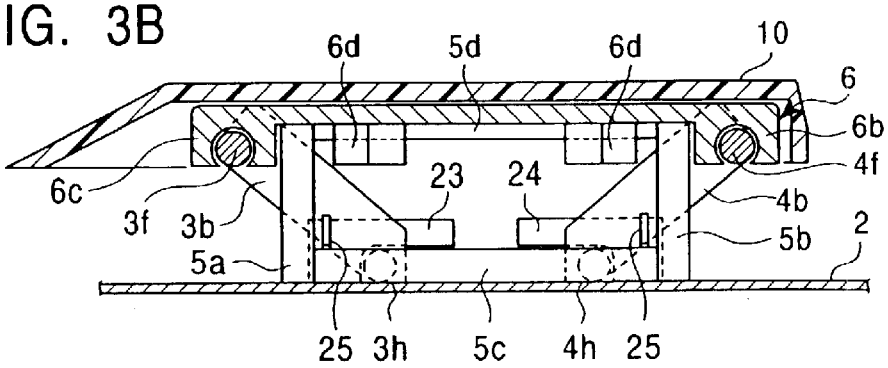
FIG. 3B is a partial sectional side view of the structure of the keyswitch device shown in FIG. 1.
Figure 3C:
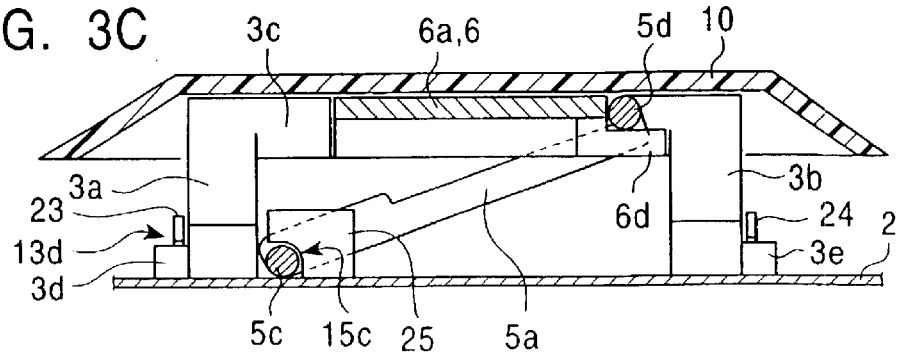
FIG. 3C is a partial sectional front view of the keyswitch device shown in FIG. 1.
Figure 4:
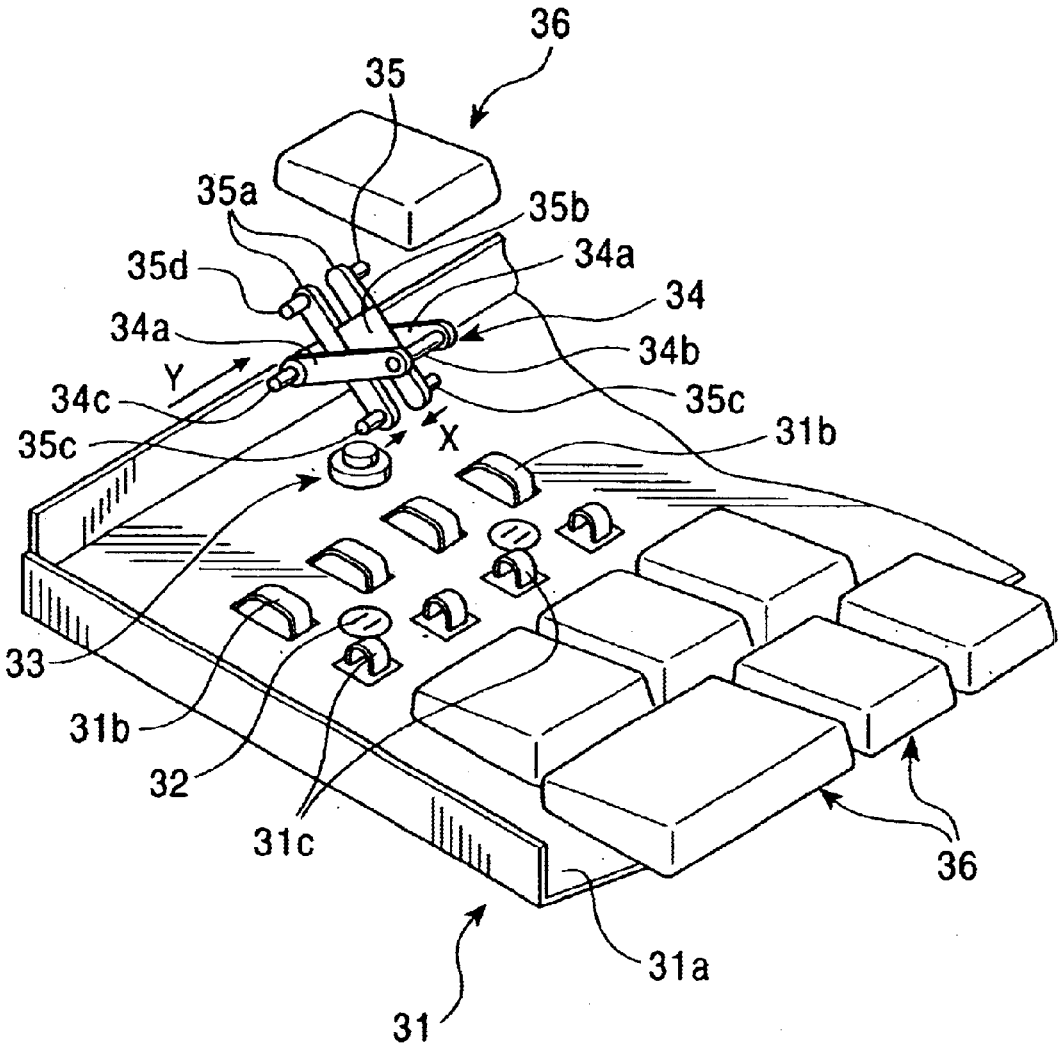
FIG. 4 PRIOR ART
FIG. 4 is an exploded perspective view of a keyboard device comprising a related keyswitch device.
Figure 5:
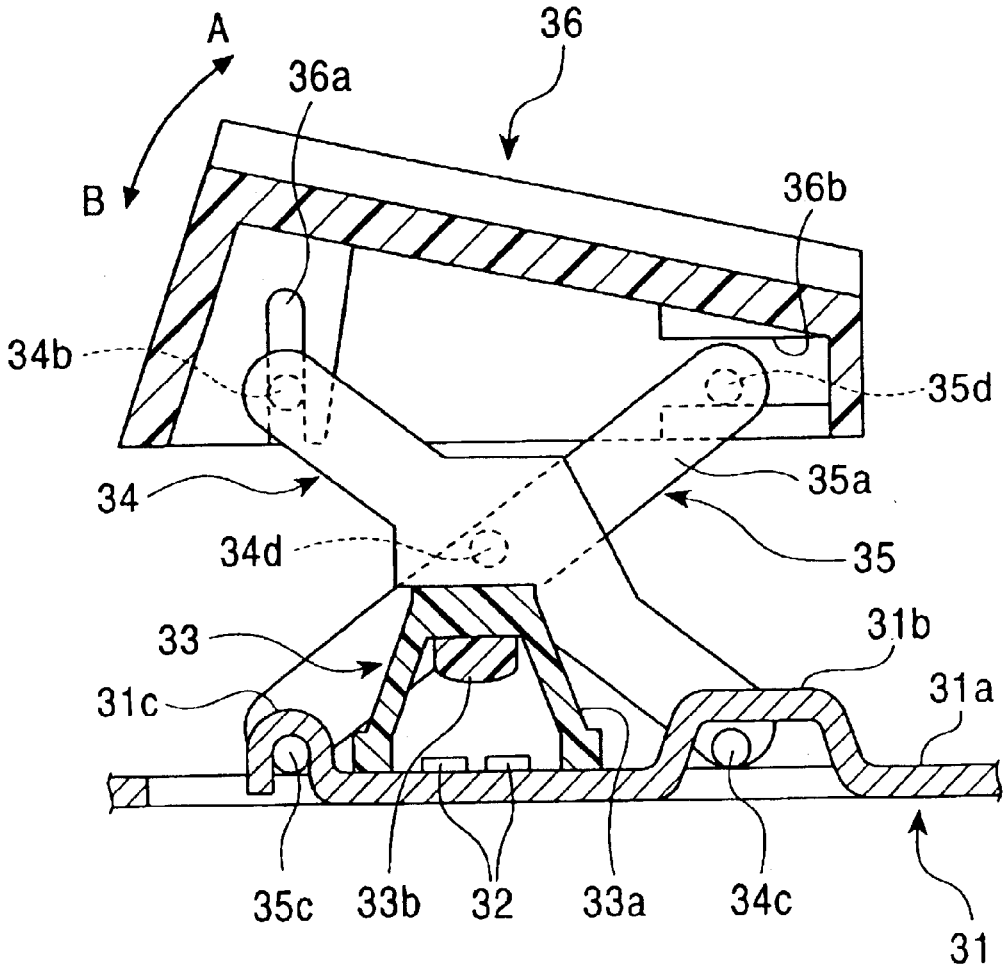
FIG. 5 PRIOR ART
FIG. 5 is a sectional view of the keyswitch device shown in FIG. 4.

Hereunder, a description of preferred embodiments of the present invention will be given with reference to the drawings. The present invention is not limited to the embodiments described below. FIG. 1 is a structural perspective view of a keyswitch device of an embodiment of the present invention. FIG. 2 is an exploded perspective view of the keyswitch device shown in FIG. 1. FIG. 3A is a top perspective view of the keyswitch device shown in FIG. 1, FIG. 3B is a partial sectional side view of the structure of the keyswitch device shown in FIG. 1, and FIG. 3C is a partial sectional front view of the structure of the keyswitch device shown in FIG. 1.

A keyswitch device 1 shown in these figures comprises a base plate (base) 2, a first lever 3, a second lever 4, a third lever 5, a holder 6, and a key cap 10. One side of each of the first lever 3, the second lever 4, and the third lever 5 engages the base plate 2. The holder 6 engages the sides opposite to the sides at the base plate 2 side of the levers 3 and 4. The key cap 10 is adhered to holder 6. In the embodiment, the holder 6 and the key cap 10 form a keytop of the keyswitch device 1.

The base plate 2 is a substantially flat member formed of a metallic material. The base plate 2 has a pair of slide bearings 23, a pair of slide bearings 24, and a pair of rotary bearings 25 in order to rotatably engage the levers 3, 4, and 5. They are formed by forming cuts in portions of the base plate 2 in a cantilever manner and raising the cut portions that are joined at one side. These pairs of cut-and-raised portions are formed parallel to each other. By this, the pairs of cut-and-raised portions having the shape of hooks as viewed from a side are formed. These cut-and-raised portions correspond to the slide bearings 23, the slide bearings 24, and the rotary bearings 25. Hook-shaped ends 23*a* of the slide bearings 23 and hook-shaped ends 24*a* of the slide bearings 24 face each other. The cut-and-raised portion of one of the rotary bearings 25 is disposed between the slide bearings 23, and the cut-and-raised portion of the other rotary bearing 25 is disposed between the slide bearings 24. The cut-and-raised portions of the slide bearings 23 and those of the slide bearings 24 are perpendicular to the cut-and-raised portions of the rotary bearings 25 in plan view. Bearing portions 23*b* and 23*b* of the slide bearings 23 and 23 are coaxially formed with respect to one of the rotary bearings 25, and bearing portions 24*b* and 24*b* of the slide bearings 24 and 24 are coaxially formed with respect to the other rotary bearing 25. Bearing portions 25*b* and 25*b* are also coaxially formed. The base plate 2 can be freely changed in size within a range which allows the levers 3 to 5 to be engaged and supported. In addition, the base plate 2 may formed of other materials, such as resinous material.

The levers 3 to 5 are each formed of, for example, a resinous or a metallic material. The levers 3 to 5 support the holder 6 and the key cap 10 so that the holder 6 and the key cap 10 can move vertically, and operate so that the vertical-movement width is confined with a predetermined range. The first lever 3 has a U shape in plan view. In the first lever 3, a pair of arms 3*a* and 3*b* and a connecting section 3*c* connecting the arms 3*a* and 3*b* are integrally formed. At the outer surfaces of ends of the arms 3*a* and 3*b*, shafts 3*d* and 3*e* that engage the respective slide bearings 23 of the base plate 2 are coaxially formed so as to protrude outward from the lever 3. These shafts 3*d* and 3*e* engage the bearing portions 23*b* of the respective slide bearings 23, so that the first lever 3 is rotatable with respect to the base plate 2 around the shafts 3*d* and 3*e*. The shafts 3*d* and 3*e* are slidable within a range in which they are guided by their respective slide bearings 23. In other words, by the slide bearings 23 of the base plate 2 and the respective shafts 3*d* and 3*e* of the first lever 3, respective slide engagers (first engagers) 13*d* and 13*e* are formed. Tapering portions 3*g* and 3*h* are formed at the bottom surfaces (at base plate 2 sides) of end portions of the respective arms 3*a* and 3*b* of the first lever 3, and have the same angles of inclination with respect to their respective arms 3*a* and 3*b*. These tapering portions 3*g* and 3*h* determine the angle of the first lever 3 with respect to the base plate 2. When the first lever 3 is maximally raised, these tapering portions 3*g* and 3*h* are in contact with the top surface of the base plate 2, and operate to restrict the angle at which the first lever 3 is raised (or the raise angle thereof). This raise angle of the first lever 3 can also be defined by the slide widths of the shafts 3*d* and 3*e* within their respective slide bearings 23. A circular cylindrical shaft 3*f* that is slightly thinner than both ends of the connecting section 3*c* is formed at the central portion of the connecting section 3*c* of the first lever 3. By fitting the shaft 3*f* to the holder 6 (described later), the first lever 3 is rotatable with respect to the holder 6.

The second lever 4 is formed with the same shape as the first lever 3, and comprises arms 4*a* and 4*b* and a connecting section 4*c* connecting the arms 4*a* and 4*b*. Shafts 4*d* and 4*e* are coaxially provided at the outer surfaces of ends of the respective arms 4*a* and 4*b* so as to protrude therefrom. These shafts 4*d* and 4*e* engage the bearing portions 24*b* of the respective slide bearings 24, so that the second lever 4 can rotate with respect to the base plate 2 around the shafts 4*d* and 4*e*. The shafts 4*d* and 4*e* can slide in their respective slide bearings 24. In other words, by the slide bearings 24 of the base plate 2 and the respective shafts 4*d* and 4*e* of the second lever 4, respective slide engagers (first engagers) 14*d* and 14*e* are formed. A circular cylindrical shaft 4*f*, disposed at the central portion of the connecting section 4*c*, is such as to be fitted to the holder 6. As shown in FIG. 3B, tapering portions 4*h* are formed at the bottom surfaces of ends of the arms 4*a* and 4*b*, so that the raise angle of the second lever 4 can be defined.

The third lever 5 has the shape of a frame in plan view, and comprises arms 5*a* and 5*b*, which tilt with respect to the base plate 2 like the arms of the first and second levers 3 and 4, and shafts 5*c* and 5*d*, disposed between respective ends of the arms 5*a* and 5*b*. The shafts 5*c* and 5*d* have circular cylindrical shapes. The shaft 5*c* engages the rotary bearings 25. The shaft 5*d* slidably engages the holder 6. Therefore, as shown in FIG. 3A, in the third lever 5, the shaft 5*c* engaging the base plate 2 engages the rotary bearings 25 and 25, so that rotary engagers (second engagers) 15*c* and 15*c* are formed. Along with the holder 6, the shaft 5*d* forms slide engagers (first engagers) 16*d*.

When the levers 3 to 5 are incorporated in the keyswitch device 1, the levers 3 and 4 are disposed symmetrically on the left and right sides as shown in FIG. 3B, and the lever 5 is disposed by being surrounded by the levers 3 and 4 as shown in FIG. 3A. The shafts 3*f* and 4*f* of the respective first and second levers 3 and 4 are disposed perpendicular to the shaft 5*d* of the third lever 5 in plan view. In the keyswitch device 1 of the embodiment, the shaft 3*f* at the keytop side (at the holder 6 side) of the first lever 3 is disposed outwardly of the shafts 3*d* and 3*e* at the base plate 2 side of the first lever 3, and the shaft 4*f* at the keytop side of the second lever 4 is disposed outwardly of the shafts 4*d* and 4*e* at the base plate 2 side of the second lever 4. At the engagers of the base plate 2 and the levers 3 to 5, the levers 3 and 5 are at their respective slide bearings 23 to 25 with which they engage, so that movement in the directions of their rotary shafts are restricted. Therefore, rattling of the levers 3 to 5 on the base plate 2 is restricted.

The holder 6 comprises a substantially flat base 6*a*; bearings 6*c* and 6*b*, disposed on both sides of the base 6*a*; and slide bearings 6*d* and 6*d*, which are L-shaped as viewed from a side. The bearings 6*c* and 6*b* have the shapes of quadratic prisms that are long sideways along the direction of the surface of the base 6*a*, and have respective tunnel-shaped grooves 6*e* and 6*f* formed therein in the lengthwise directions in the bottom surface (base plate 2 side) of the holder 6. The grooves 6*e* and 6*f* extend parallel to each other. The shaft 3*f* of the first lever 3 and the shaft 4*f* of the second lever 4 are rotatably inserted in the respective grooves 6*e* and 6*f*, so that respective rotary engagers (second engagers) 13*c* and 14*c* are formed. The bearings 6*c* and 6*b* are formed with almost the same lengths as the shaft 3*f* of the first lever 3 and the shaft 4*f* of the second lever 4, respectively. Gaps between the bearings 6*c*and 6*b* and the shafts 3*f* and 4*f* when they are fitted to each other are made as small as possible within a range allowing smooth rotation of the shafts 3*f* and 4*f*. By this structure, movements of the first and second levers 3 and 4 and the holder 6 in the axial directions of the shafts 3*f* and 4*f* are restricted. In other words, by the shaft 3*f* at the central portion of the connecting section 3*c* of the first lever 3 and stepped side walls 3*m* and 3*m* at the boundary at both ends of the connecting section 3*c*, the position of the bearing 6*c* of the holder 6 in the lengthwise direction thereof is restricted. By side walls 4*m* and 4*m* at the boundary at both ends of the shaft 4*f* at the connecting section 4*c* of the second lever 4, the position of the bearing 6*b* of the holder 6 in the lengthwise direction thereof is restricted. Since the bearings 6*b* and 6*c* and the base 6*a* are integrally formed, the positions of the first and second levers 3 and 4 and the holder 6 are restricted in the axial directions of the shafts 3*f* and 4*f*. The two slide bearings 6*d* and 6*d* have L shapes as viewed from their sides. The outer surfaces of ends of the slide bearings 6*d* and 6*d* are connected to the illustrated back side surface of base 6*a* so as to be spaced from each other by a predetermined interval. In other words, the top surfaces of the slide bearings 6*d* and 6*d* are disposed closer to the base plate 2 by being one level lower than the base 6*a*. By disposing the shaft 5*d* of the lever 5 on the slide bearings 6*d* and 6*d*, the slide engagers (first engagers) 16*d* and 16*d* shown in FIG. 1 are formed. At the slide engagers 16*d* and 16*d*, the shaft 5*d* is slidable on the slide bearings 6*d* and 6*d* within a range in which the shaft 5*d* is guided on the slide bearings 6*d* and 6*d*. The outside width between the slide bearings 6*d* and 6*d* that are disposed side by side (that is, the distance from the outer surface of one of the slide bearings 6*d* to the outer surface of the other slide bearing 6*d*) is about the same as the inside width between the arms 5*a* and 5*b* of the third lever 5 (that is, the distance between the inner surfaces of the arms 5*a* and 5*b*), so that movements of the holder 6 and the third lever 5 in the axial direction of the shaft 5*d* are restricted.

A switch 9 comprises a movable section 9*b* and a contact section 9*a*. The movable section 9*b* is formed of, for example, an elastic resinous material, such as rubber, and has the shape of an inverted cup. The contact section 9*a* is disposed on the top portion of the inner surface of the movable section 9*b*. With the wide side of the switch 9 facing the base plate 2, the switch 9 is disposed on the base plate 2 so as to be surrounded by the base 6*a* of the holder 6 and the levers 3 to 5. The contact section 9*a* is disposed opposing a stationary contact (not shown) disposed on the base plate 2. The switch 9 biases the holder 6 upward when it is not used. The switch 9 may be replaced by a sheet switch (which has upper sheets having movable contacts formed thereon and lower sheets having stationary contacts formed thereon stacked upon each other so that the contacts oppose each other) disposed on the upper side or the lower side of the base plate 2.

The key cap 10 is, for example, molded so that its outer shape is substantially trapezoidal. It has the shape of an inverted boat with an open bottom. A character (not shown), such as a number or an alphabetic letter, is printed on the top surface of the key cap 10. The key cap 10 is connected to the holder 6, so that a keytop of the keyswitch device 1 is formed. Obviously, the key cap 10 may be integrally formed with the holder 6.

In the keyswitch device 1 of the embodiment comprising the aforementioned structural members, in the non-operation state, as shown in FIG. 1, the holder 6 and the key cap 10 are biased upward by the elastic force of the switch 9. When the top surface of the key cap 10 is pressed by a key input operation, the holder 6 connected to the key cap 10 is moved downward in response to the movement of the key cap 10. Then, the switch 9 that is pushed by the bottom surface of the holder 6 is deformed, causing the contact section at the inner portion of the switch 9 to come into contact with a stationary contact on the base plate 2, so that the switch is turned on. When a finger is moved away from the key cap 10, the switch 9 elastically returns to its original state, and biases the holder 6 and the key cap 10 upward again.

The vertical movements of the key cap 10 cause the levers 3 to 5 to operate in the following manner. As the engagers of the symmetrically disposed first lever 3 and the second lever 4 and the holder 6 move downward, the shafts 3*d* and 3*e* engaging the slide bearings 23 and the shafts 4*d* and 4*e* engaging the slide bearings 24 move horizontally inside their respective slide bearings 23 and their respective slide bearings 24. In other words, the ends of the arm 3*a* of the first lever 3 and the ends of the arm 4*a* of the second lever 4 are moved towards each other, causing the respective shafts 3*f* and 4*f* to be moved downward. Since the engagers of the third lever 5 and the rotary bearings 25 of the base plate 2 are stationary, as the holder 6 is moved downward, the shaft 5*d* is tilted while it slides on the slide bearings 6*d* of the holder 6.

In this way, since, unlike the related keyswitch device having an X-shaped supporting structure, the keyswitch device 1 of the embodiment does not have a rotary shaft at the central portions of the levers, even if the levers 3 to 5 are shortened to reduce the size and thickness of the keyswitch device, the levers 3 to 5 can be made shorter and smaller than the levers used in the related example, while allowing the structural parts of the keyswitch device to move smoothly vertically. Therefore, if the keyswitch device 1 of the embodiment is included as input means, a keyboard device or an electronic device can be easily reduced in size and thickness without impairing the operability of the keyswitch device 1 at the time of a key input operation.

In the keyswitch device 1 of the embodiment, the key cap 10 can be moved vertically while being held in a horizontal state, so that it is possible to prevent improper pressing of a key. Therefore, key input operation can be reliably performed. This is because, by providing the levers 3 to 5, the keyswitch device 1 has a structure in which the key cap 10 (and, thus, the holder 6) does not tilt when a peripheral edge of the key cap 10 is pressed. In other words, if the case where the third lever 5 is not provided is considered, the holder 6 may tilt in the direction around the shafts 3*f* and 4*f* (at the holder 6 side) of the respective first and second levers 3 and 4 that are symmetrically disposed on the left and right sides. However, in the embodiment, by providing the lever 5, the tilting of the holder 6 in the direction around the shafts 3*f* and 4*f* is restricted by the shaft 5*d* disposed in the direction in which it intersects the shafts 3*f* and 4*f*.

The keyswitch device 1 of the embodiment can have excellent operability during a key input operation almost without any rattling of the keytop in the horizontal direction. This is because a structure which restricts rattling in the horizontal direction at the engagers of the levers 3 to 5 and the holder 6 and the engagers of the levers 3 to 5 and the base plate 2 is used. In other words, at the engagers of the base plate 2 and the levers 3 to 5, the bearings 23 to 25 are formed by first forming pairs of parallel cut-and-raised portions, so that movements in the axial direction of the levers engaged at the locations where they are sandwiched at the respective bearings 23 to 25 are restricted by the bearings 23 to 25; and, at the engagers of the holder 6 with the levers 3 to 5, the bearings 6*c* and 6*b* of the holder 6 are fitted to the circular cylindrical shafts 3*f* and 4*f* that are slightly thinner than the connecting sections 3*c* and 4*c* of the respective first and second levers 3 and 4, so that movement of the holder 6 in the axial directions of the shafts 3*f* and 4*f* is restricted by the side walls 3*m* at both ends of the shaft 3*f* and the side walls 4*m* at both ends of the shaft 4*f*.

In this way, according to the keyswitch device 1 of the embodiment, there is no tilting of the keytop when the keytop is moved vertically during a key input operation. In addition, there is almost no rattling of the keytop, so that it is possible to prevent improper pressing of the keyswitch device, and, thus, to provide a keyswitch device having excellent operability.

The present invention is not limited to the above-described embodiment, so that modifications may be made as required within the technical scope of the present invention. For example, although, in the keyswitch device 1 shown in FIG. 1, the first and second levers 3 and 4 are symmetrically disposed with respect to the center of the keyswitch device 1, the first and second levers 3 and 4 may be tilted in the same direction, or hinges may be formed at the arms 3*a* and 3*b* of the first lever 3 and the arms 4*a* and 4*b* of the second lever 4, so that the keytop is moved vertically by bending at the hinges.

Figure 6:
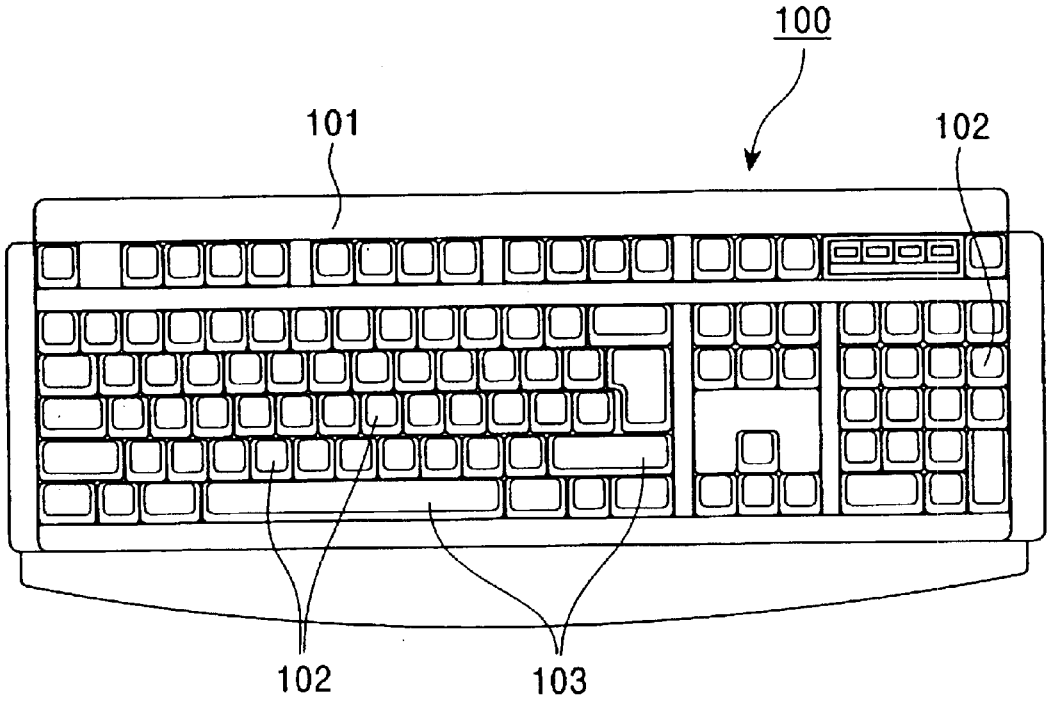
FIG. 6 is a plan view of an embodiment of a keyboard device comprising the keyswitch device of the present invention.

FIG. 6 is a perspective view of an embodiment of a keyboard device including the keyswitch device of the embodiment. A keyboard device 100 comprises a plurality of keyswitch devices 102 disposed on a frame 101. In the keyboard device 100 of the embodiment having such a structure, the keytops are held horizontally when the keytops are moved vertically. In addition, by including the keyswitch devices 102 in which there is almost no rattling of the keytops, a user will not improperly press a key during a key input operation, so that the key operation can be comfortably carried out. For large keyswitch devices 103, such as a space key, a plurality of the structural parts, excluding the key cap 10, of the keyswitch device 1 may be disposed below the key cap 10 that is long sideways.

As described in detail above, the keyswitch device comprises a base; a plurality of levers, one side of each lever movably engaging the base; a keytop supported so as to be movable vertically with respect to the base by being engaged with the other side of each lever; and a switch for performing a switching operation as the keytop is moved vertically. In the keyswitch device, rotary shafts for allowing rotation of the respective levers within respective rotational planes are disposed at respective engagers at both sides of the levers. One of the engagers at each lever is a first engager for movably supporting one of the rotary shafts at the base or the keytop. The other engager at each lever is a second engager for rotatably supporting the other rotary shaft. The rotary shafts disposed at the engagers of at least one of the plurality of levers are oriented so as to cross the rotary shafts or rotary shaft lines disposed at the engagers of another lever. Therefore, the keyswitch device of the present invention can be easily reduced in size and thickness compared to the related keyswitch device having an X-shaped supporting structure. In addition, the operability of the keyswitch device during a key input operation is not impaired when it is reduced in size and thickness. Further, in the keyswitch device, rattling of the keytop in the horizontal direction is prevented from occurring. Still further, in the keyswitch device, when a peripheral edge of the top surface of the keytop is pressed, the keytop is not moved downward in a tilted state, so that it is moved downward while being kept substantially horizontal. Therefore, a user will not improperly press the keytop during a key input operation, and rattling of the keytop does not occur, so that the keyswitch device has excellent operability.

When the keyboard device of the present invention comprises the keyswitch device of the present invention, size reduction can be easily achieved. In addition, a user can comfortably perform a key input operation, so that the keyboard device has excellent operability.

What is claimed is:

1. A keyswitch device comprising:

a base;

a plurality of levers, one side of each of the levers movably engaging the base;

a keytop supported so as to be movable vertically with respect to the base by being engaged with another side of each levers; and a switch that performs a switching operation when the keytop is moved vertically, wherein rotary shafts which allow rotation of the levers within respective rotational planes are disposed at respective engagers at both sides of the levers;

wherein one of the engagers at each of the levers is a first engager that movably supports one of the rotary shafts at one of the base and the keytop;

wherein another of the engagers at each of the levers is a second engager that rotatably supports another of the rotary shafts; and wherein the rotary shafts disposed at the engagers of at least one of the plurality of levers are oriented so as to cross one of the rotary shafts and rotary shaft lines disposed at the engagers of another of the levers.

2. A keyswitch device according to claim 1, wherein the plurality of levers comprise a first lever, a second lever, and a third lever, with the rotary shafts of the first and second levers being disposed parallel to each other, and the rotary shafts of the third lever being oriented so as to intersect the rotary shafts of the first and second levers.

3. A keyswitch device according to claim 2, wherein the engager of the first lever and the keytop and the engager of the second lever and the keytop are disposed outwardly of the engager of the first lever and the base and the engager of the second lever and the base, respectively, wherein the engager of the first lever and the keytop and the engager of the second lever and the keytop are the second engagers that rotatably support the rotary shafts, and wherein the engager of the first lever and the base and the engager of the second lever and the base are the first engagers that movably support the rotary shafts.

4. A keyswitch device according to claim 3, wherein, at the engager of the first lever and the base and at the engager of the second lever and the base, the rotary shaft of the first lever and the rotary shaft of the second lever engage respective hook-shaped slide bearings disposed at the base, and wherein the rotary shafts of the first and second levers are slidable within a range in which the rotary shafts are guided in the respective hook-shaped slide bearings.

5. A keyswitch device according to claim 4, wherein the first lever and the second lever are each sandwiched at a pair of the hook-shaped slide bearings that are disposed at the base and that engage the first and second levers, and wherein positions of the first lever and the second lever in lengthwise directions of the rotary shafts are restricted by the respective pairs of the hook-shaped slide bearings.

6. A keyswitch device according to claim 2, wherein the third lever is sandwiched at a pair of hook-shaped rotary bearings disposed at the base, and wherein a position of the third lever in a lengthwise direction of the rotary shafts is restricted by the hook-shaped rotary bearings.

7. A keyswitch device according to claim 2, wherein the keytop and the first and second levers are engaged by disposing the shafts of the first and second levers in respective bearings of the keytop, wherein one of the bearings of the keytop is sandwiched by side walls at sides of the shaft of the first lever, wherein another of the bearings of the keytop is sandwiched by side walls at sides of the shaft of the second lever, and wherein positions of the bearings of the keytop in lengthwise directions of the bearings are restricted by the side walls.

8. A keyswitch device according to claim 2, wherein the keytop and the third lever are engaged by disposing the shaft of the third lever in a slide bearing of the keytop, and wherein the shaft is disposed and slidable on a guide plate disposed at the slide bearing.

9. A keyswitch device according to claim 1, wherein the keytop comprises a holder, engaging the plurality of levers, and a key cap adhered to the holder.

10. A keyswitch device according to claim 1, wherein the levers each comprise a pair of arms and at least one connecting section that connects the arms, the levers having one of a U shape and a frame shape, and wherein the first engager and the second engager are disposed on respective sides of the arms.

11. A keyswitch device according to claim 1, wherein the rotary shafts of the levers whose rotary shafts cross each other are disposed at right eagles.

12. A keyboard board device comprising the keyswitch device of claim 1.

* * * * *

UNITED STATES PATENT AND TRADEMARK OFFICE

CERTIFICATE OF CORRECTION

PATENT NO. : 6,723,935 B1
DATED : April 20, 2004
INVENTOR(S) : Makoto Watanabe

It is certified that error appears in the above-identified patent and that said Letters Patent is hereby corrected as shown below:

Column 11,
Line 50, before “levers;” insert -- of the --.

Signed and Sealed this

Twenty-first Day of December, 2004

JON W. DUDAS
*Director of the United States Patent and Trademark Office*